US005343232A

United States Patent [19]

Ueno

[11] Patent Number: 5,343,232

[45] Date of Patent: Aug. 30, 1994

[54] MULTIPLE-NEEDLE ELECTRODE HEAD

[75] Inventor: Noboru Ueno, Nagano, Japan

[73] Assignee: Nippon Steel Corporation, Tokyo, Japan

[21] Appl. No.: 894,850

[22] Filed: Jun. 5, 1992

[30] Foreign Application Priority Data

Jun. 7, 1991 [JP] Japan ..... 3-163609

[51] Int. Cl.[5] ..... B41J 2/395; B41J 2/385; B41J 2/41

[52] U.S. Cl. ..... 346/155; 346/139 C; 346/76 PH; 29/611

[58] Field of Search ..... 346/76 PH, 155, 139 C; 29/611

[56] References Cited

U.S. PATENT DOCUMENTS 5,028,935 7/1991 Warmack et al. ..... 346/76 PH
5,107,283 4/1992 Ueno et al. ..... 346/155

FOREIGN PATENT DOCUMENTS 53-20929 2/1978 Japan .
56-110959 2/1981 Japan .
56-122056 9/1981 Japan .

*Primary Examiner*—Benjamin R. Fuller
*Assistant Examiner*—Huan Tran
*Attorney, Agent, or Firm*—Pollock, Vande Sande & Priddy

[57] ABSTRACT

There are disclosed a multiple-needle electrode head and its manufacturing method. The head comprises: a first head half body including at least two electrode substrates, each having needle-shaped electrodes formed in a row on its one surface and insulated from each other, the at least two electrode substrates being joined in the row direction and adhered onto a first side plate; and a second head half body including at least two electrode substrates, each having needle-shaped electrodes formed in a row on one surface and insulated from each other, the at least two electrode substrates being joined in the row direction and adhered to a second side plate. The first and second head half bodies are coupled so that the electrode substrates of each of the head half bodies are located inside and the electrodes of the first head half body and the electrodes of the second head half body are insulated from each other.

11 Claims, 5 Drawing Sheets

MULTIPLE-NEEDLE ELECTRODE HEAD

FIELD OF THE INVENTION

The present invention relates to a multiple-needle electrode head which is used in an electrostatic printer, a plotter, an ion flow printer, and the like and a method of manufacturing the head. More particularly, this invention relates to a long multiple-needle electrode head which can print at a high density and a wide width and a method of manufacturing the head.

BACKGROUND OF THE INVENTION

In the electrostatic printer or electrostatic plotter, the printing is carried out by forming an electrostatic latent image on an electrostatic recording sheet by using a multiple-needle electrode head, developing the latent image by using a toner and then fixing. The multiple-needle electrode head which is used in such an apparatus is made by forming a large number of recording electrodes on front and back surfaces of an electrode substrate, molding the substrate by an epoxy resin or the like and polishing for finishing its front edge, as disclosed, for example, in JP-A-53-20929, JP-A-56-110959, JP-A-56-122056, and co-pending U.S. patent application Ser. No. 07/634,608 filed on Dec. 27, 1990 now U.S. Pat. No. 5,107,283.

In case of a double-row multiple-needle electrode head which is used in a large electrostatic plotter, for instance, in an apparatus for printing on a sheet of the A0 size, a width in the longitudinal direction of an electrode substrate is about one meter and about 7200 needle-shaped recording electrodes (hereinafter, also simply referred to as electrodes) on each side, or total 14400 electrodes are formed in parallel on both of the front and back sides. When the electrode substrate is large as mentioned above and the electrodes are formed by a technique such as plating or etching, it is difficult to make the width of the electrode pattern uniform in the formation of the electrodes. In addition, since the electrodes are formed at a predetermined very fine pitch such as 0.127 mm, the rate in generation of defects such as short-circuit between the electrodes and breakage of the electrodes, becomes high. Moreover, even if only one of a large number of electrodes is defective, the whole electrode substrate is regarded as a defective article. Consequently, the conventional multiple-needle electrode head involves a problem that the manufacturing of the same is extremely difficult and a yield is low.

In case of the multiple-needle recording head using an electrode substrate having a length of one meter, it is impossible to process such a long electrode substrate by conventional plating apparatus, exposing apparatus, or the like. To form such a long electrode substrate, therefore, it is necessary to make large the size of processing apparatus such as plating apparatus, exposing apparatus or etching apparatus, resulting in high production cost.

Further, in order to obtain a highly precise recording image, the electrode substrate is required to have a highly accurate linearity in its longitudinal direction. However, as the length of electrode substrate becomes larger, it becomes more difficult to realize the highly accurate linearity.

SUMMARY OF THE INVENTION

The present invention is made in consideration of the above circumstances and it is an object of the invention to provide a multiple-needle electrode head which can be easily manufactured with an electrode substrate having a highly accurate linearity in its longitudinal direction and also to provide a method of manufacturing the head.

To accomplish the above object, a multiple-needle electrode head according to the invention comprises: a first head half body in which at least two electrode substrates, each having needle-shaped electrodes formed in a row on its one surface, are connected to extend in a direction of the row of the electrodes and adhered to one side plate; and a second head half body in which at least two electrode substrates, each having needle-shaped recording electrodes formed in a row on its one surface, are connected to extend in a direction of the row of the electrodes and adhered to another one side plate, wherein the first and second head half bodies are joined such that the respective electrode substrates are located inside in a state in which the recording electrodes of the first head half body are insulated from the recording electrodes of the second head half body.

To accomplish the above object, a method of manufacturing a multiple-needle electrode head according to the invention comprises the steps of: forming a pair of head half bodies in a manner such that at least two electrode substrates, each having needle-shaped recording electrodes formed in a row on its one surface and insulated from one another, are connected to extend in a direction of the row of the electrodes and adhered to one side plate; and joining the pair of head half bodies so that the electrode substrates are located inside in a state in which the electrodes of the first head half body are insulated from the electrodes of the second head half body.

According to the invention with the above construction, the electrode substrate is formed by adhering at least two electrode substrates to one side plate, it is possible to adjust each electrode substrate to a size adapted to the existing plating apparatus or the like, so that each electrode substrate can be easily manufactured by using the existing plating apparatus or the like. On the other hand, the surface of the side plate to which the electrode substrates are adhered is finished with a highly accurate flat plane so that a highly accurate linearity of the whole structure can be easily obtained.

DESCRIPTION OF THE PREFERRED EMBODIMENTS

Figure 1:
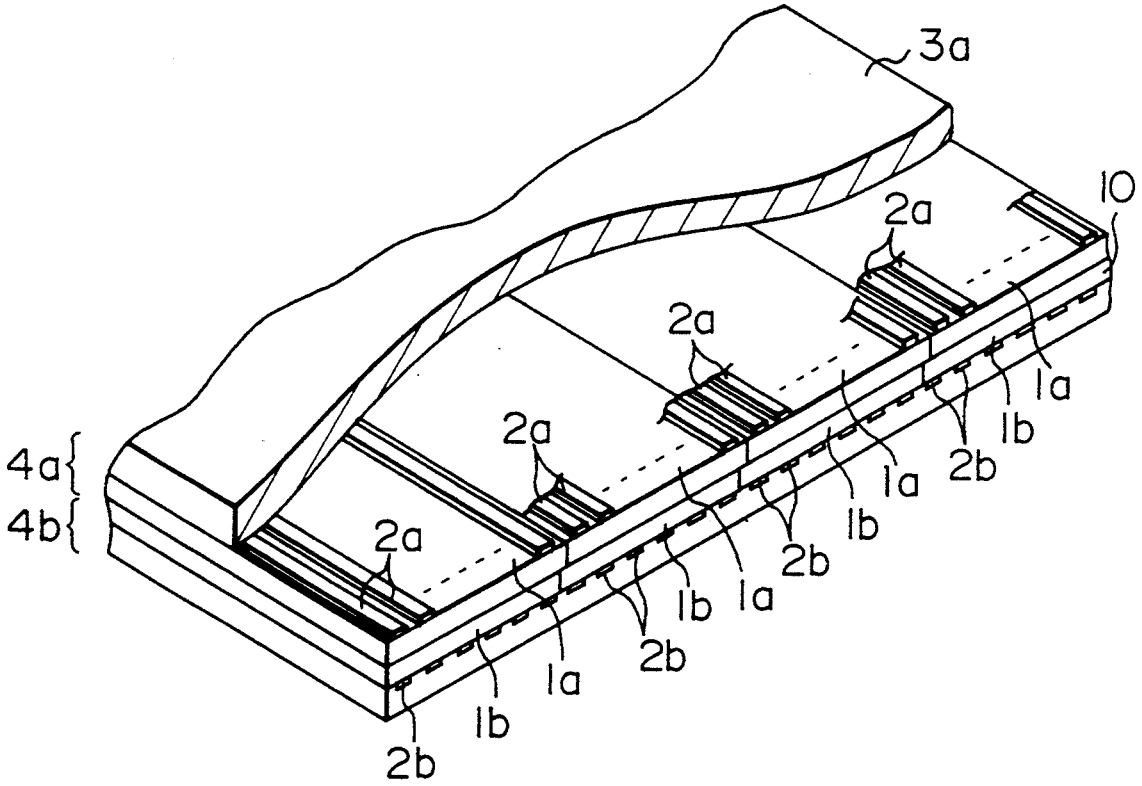
FIG. 1 is a partially broken perspective view showing a construction of a multiple-needle electrode head according to an embodiment of the invention.
Figure 2A:
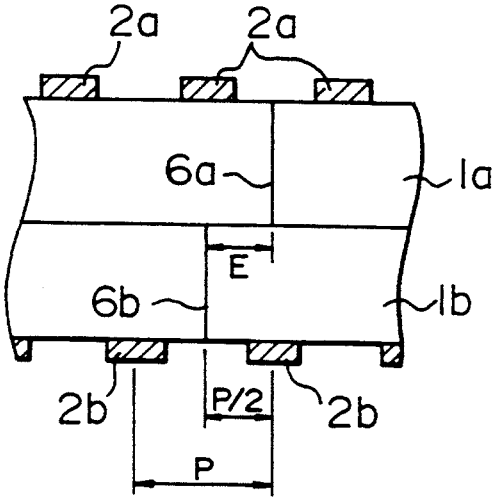
FIGS. 2A and 2B are diagrams for explaining a method of joining a unit electrode substrate which is used in the embodiment of FIG. 1.
Figure 2B:
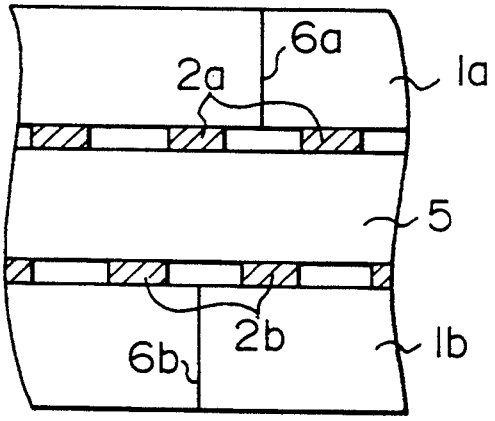
Figure 3:
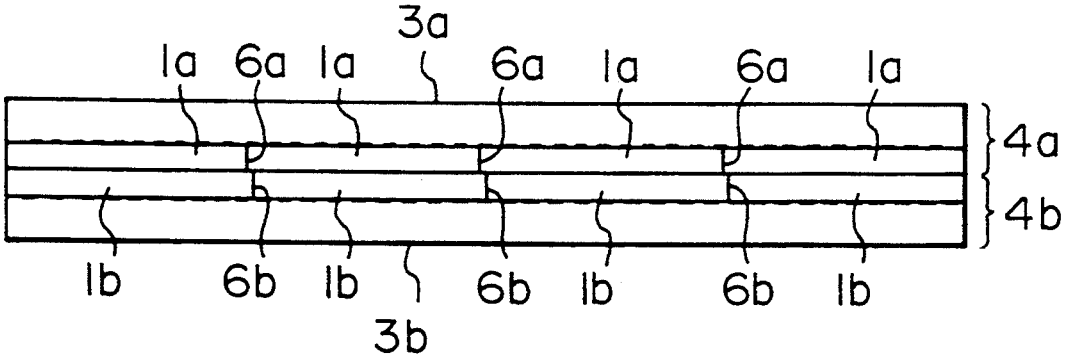
FIG. 3 is a front view of the multiple-needle electrode head of FIG. 1.

An embodiment of the present invention will be described hereinbelow with reference to the drawings. FIG. 1 is a schematic perspective view of a multiple-needle electrode head according to an embodiment of the present invention. FIGS. 2A and 2B are partial enlarged side elevational views each showing a joining state of electrode substrates of the embodiment. FIG. 3 is a schematic front view of the multiple-needle electrode head of the embodiment. In FIG. 1, a surface 10 where the ends of the electrodes are exposed is an operational surface of the head which is in contact with a recording paper sheet in the recording mode.

The multiple-needle electrode head of the embodiment includes head half bodies 4*a* and 4*b*. The head half body 4*a* comprises four unit electrode substrates 1*a* of insulating material, each including a number of electrodes 2*a* formed in a row on its one surface at a predetermined pitch P and insulated from one another and a side plate 3*a* of an insulating material to which the four unit electrode substrates 1*a*, as joined one another in the direction of the row of the electrodes 2*a*, are adhered. Similarly, the head half body 4*b* also comprises four unit electrode substrates 1*b*, each including a number of electrodes 2*b* formed in a manner similar to the electrodes 2*a* and a side plate 3*b* to which the four unit electrode substrates 1*b*, as joined one another in the row direction of the electrodes 2*b*, are adhered.

The head half bodies 4*a* and 4*b* are joined, as shown in FIG. 2A with the substrate sides of the unit electrode substrates 1*a* and 1*b* being into contact with each other. Alternatively, as shown in FIG. 2B, the head half bodies 4*a* and 4*b* are joined such that the electrode sides of the unit electrode substrates 1*a* and 1*b* are facing each other with an insulative spacer 5 therebetween. As shown in FIGS. 1 and 3, the head half bodies 4*a* and 4*b* are joined such that the ends of the electrodes 2*a* of the unit electrode substrate 1*a* and the ends of the electrodes 2*b* of the unit electrode substrate 1*b* are located in a zigzag on the operational surface 10 of the head. Therefore, in the embodiment, a joining portion 6*a* between the unit electrode substrates 1*a* is deviated from a joining portion 6*b* between the unit electrode substrates 1*b* by a half of the electrode pitch P. The deviation E may be integer times as large as the half P/2 of the electrode pitch P. By shifting the joining portions 6*a* and 6*b* as shown in FIG. 2A, the joining portion of the unit electrode substrates on one side is strengthen by the other side.

A manufacturing method of the multiple-needle electrode head with the above structure will now be described. For instance, a method of manufacturing a high density multiple-needle electrode head of 400 d.p.i. (dots per inch) having a length of 36 inches by using unit electrode substrates each having a length of 9 inches will now be described.

Figure 4A:
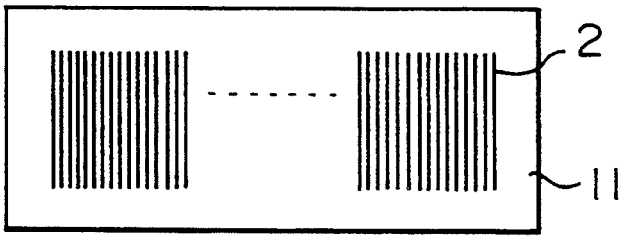
FIGS. 4A and 4B are drawings for explaining a manufacturing method of the unit electrode substrate of the embodiment of FIG. 1.
Figure 5:
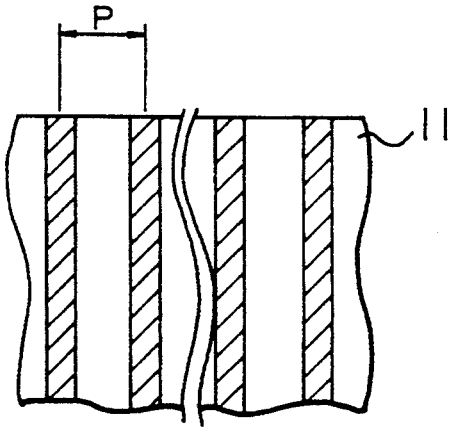
FIG. 5 is a diagram for explaining the positional relation of needle-shaped recording electrodes on the electrode substrate.

First, as shown in FIG. 4A, a printed wiring board 11 having length slightly longer than 9 inches is formed. In this step, the wiring pattern forming the electrodes is formed by a plating or etching technique, so as to obtain the printed wiring board 11 on which the pattern 2 of electrodes with a predetermined pitch P (for example, 0.127 mm) is formed as shown in FIG. 5. Such a printed wiring board of a length of about 9 inches can be relatively easily manufactured by using an existing plating or etching apparatus.

Figure 4B:
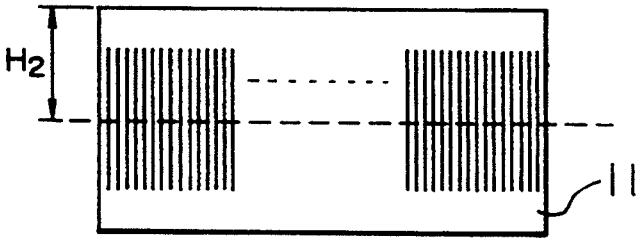
Figure 6:
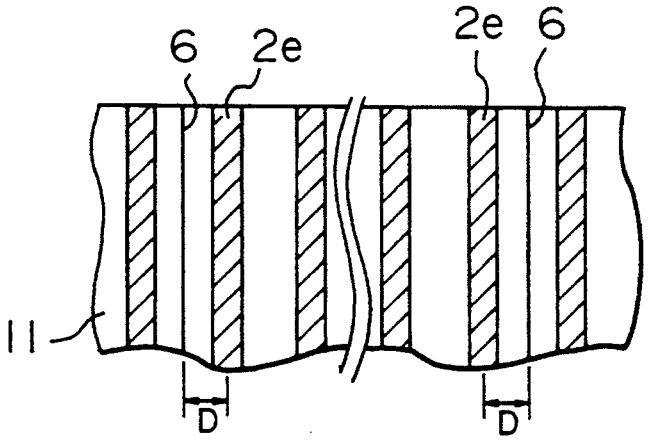
FIG. 6 is a diagram for explaining cutting positions of a printed wiring board of the embodiment of FIG. 1.

To set a length of printed wiring board 11 to a predetermined length of 9 inches, both end portions of the board 11 are cut by an accurate slicer using a diamond grindstone, for instance, thereby obtaining the printed wiring board 11 having a length of 9 inches as shown in FIG. 4B. Four printed wiring boards 11 obtained as mentioned above are joined in the longitudinal direction and adhered and fixed to a side plate. After that, the printed wiring boards 11 are cut in the central portion (shown by a broken line in FIG. 4B) of each board 11. In this manner, each pair of unit electrode substrates 1*a* and 1*b* is obtained. By forming a pair of unit electrode substrates 1*a* and 1*b* from one printed wiring board 11 as mentioned above, the widths and pitches of the electrodes of the pair of unit electrode substrates 1*a* and 1*b* are made precisely coincident with each other. When both end portions of the printed wiring board 11 are cut, as shown in FIG. 6, they are accurately cut so as to set dimension D between the center of an electrode 2*e* closest to the end portion after cut, and the end portion at a value (for instance, 0.0635 mm) smaller than P/2 of the electrode pitch P. By cutting as mentioned above, when the unit electrode substrates are joined in the row direction of the electrodes, an electrode pitch at the joined portion can be made equal to the pitch P of the electrodes at the other portion. By making the value D smaller so as to form a gap at the joined portion 6*a* or 6*b*, a thermal expansion in the longitudinal direction of each unit electrode substrate can be adsorbed by such a gap. In the above cutting operation, by using a diamond grindstone having a grain size of about #200, a good cut surface is obtained without any inconvenience such as generation of burrs or the like.

Figure 7A:
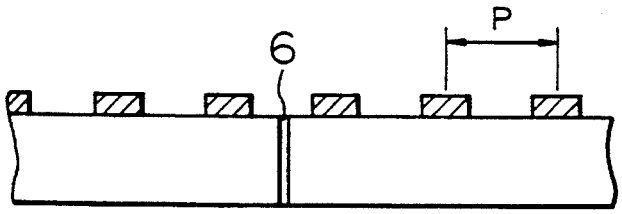
FIGS. 7A, 7B, and 7C are diagrams for explaining different manners in cutting of end portions of the printed wiring board.
Figure 7B:
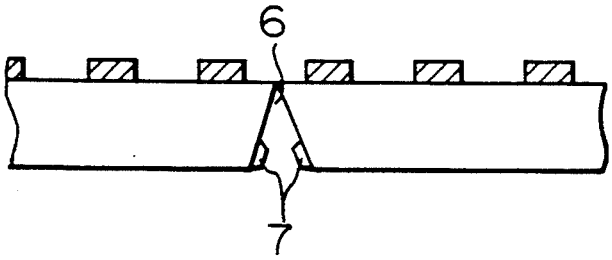
Figure 7C:
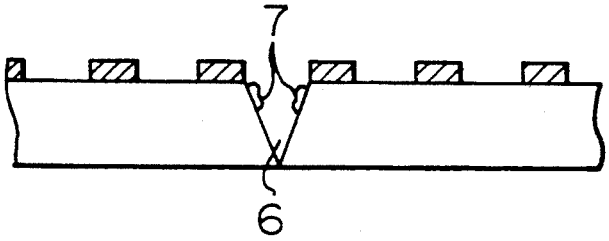

There are three methods of cutting both end portions of the printed wiring board 11, i.e. a method in which both ends of the printed wiring board 11 are vertically cut as shown in FIG. 7A; a method in which both ends of the printed wiring board 11 are cut obliquely from the front side on which the electrodes are formed to the back surface side of the board as shown in FIG. 7B; and a method in which both ends of the printed wiring board 11 are cut obliquely from the back side of the board to the front side on which the electrodes are formed as shown in FIG. 7C. The method shown in FIG. 7A is the simplest method. However, if burrs occur when both ends of the board 11 are cut, the end portions of the unit electrode substrates cannot be accurately joined so that the electrode pitch at the joined portion may become larger than the electrode pitch at the other portion. On the other hand, in the method of FIG. 7B or 7C, even if some burrs 7 occur when cutting the printed circuit board, the end portions of the unit electrode substrates can be precisely joined. Hitherto, since the multiple-needle electrode head was manufactured by using a one piece electrode substrate, it was extremely difficult to make an electrode head of a longer size with a highly accurate linearity. In this embodiment, however, since the electrode substrate is constructed of a plurality of unit electrode substrates, each unit electrode substrate can be easily made with highly accurate linearity.

The four unit electrode substrates 1 as cut are positioned by an assembling apparatus having independent tables (not shown) whose positions can be finely adjusted. After that, those four substrates are adhered through an adhesive region such as an epoxy resin under pressure to an integrated side plate 3 such as a thick plate of glass epoxy.

Figure 8A:
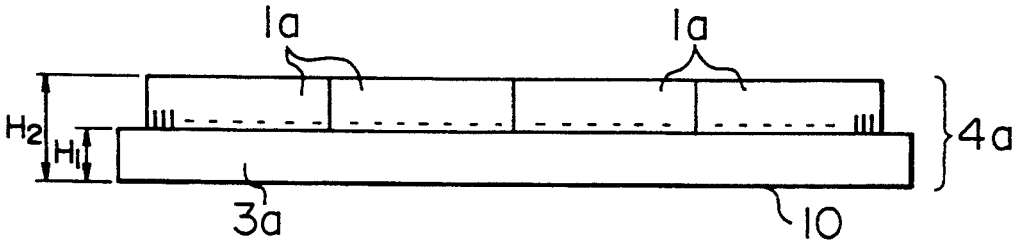
FIGS. 8A and 8B are plan views showing constructions of head half bodies which are used in manufacturing of the multiple-needle electrode head according to the invention.
Figure 8B:
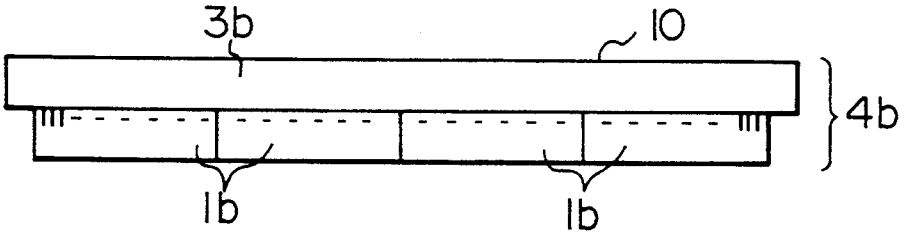

In this manner, the head half body 4*a* comprising the four electrode substrates 1*a* and the side plate 3*a* is manufactured, as shown in FIG. 8A, and the head half body 4*b* comprising the four electrode substrates 1*b* and the side plate 3*b* is also manufactured, as shown in FIG. 8B. As shown in FIGS. 8A and 8B, the electrodes are formed in only the region close to the edge of the unit electrode substrate at which the operational surface 10 of the head is formed, and no electrode is formed in the remaining region. The region in which no electrode is formed provides a space to form an electrode wiring and also a space for installing a driving IC or the like. A height $H_1$ of the side plate is made lower than a height $H_2$ of the unit electrode substrate, because if the height $H_1$ of side plate were made larger so that the side plate would cover the surface of the unit electrode substrate, exchanging works of the driving electronic parts as mentioned above could be difficult. Incidentally, the height $H_2$ denotes a size measured in the longitudinal direction of each electrode of the unit electrode substrate as shown in FIG. 4B. The height $H_1$ denotes a size of the side plate corresponding to the height $H_2$.

In case of coupling the unit electrode substrates 1*a* and 1*b* of the respective head half bodies 4*a* and 4*b*, as shown in FIG. 2A, the surfaces of the respective electrode substrates opposite to the surfaces thereof on which the electrodes are formed are joined with each other. Or, in the case where the surfaces formed with the electrodes 2*a* and 2*b* of the unit electrode substrates 1*a* and 1*b* are joined with each other, as shown in FIG. 2B, an insulating spacer 5 is interposed therebetween. As shown in FIGS. 2A and 2B, by coupling both of the unit electrode substrates 1*a* and 1*b* so that the joining portions 6*a* and 6*b* of the unit electrode substrates are located at the centers between the electrodes 2*b* and 2*a* of the other unit electrode substrates 1*a* and 1*b*, a zigzag-shaped multiple-needle electrode head having a pitch of 200 d.p.i. for one side and a pitch of 400 d.p.i. for both sides can be manufactured.

According to the embodiment mentioned above, the unit electrode substrate can be formed by using an existing plating apparatus or the like. When a defect occurs in the electrode, it is sufficient to reject only the unit electrode substrate having such a defect, so that the yield is improved. According to the embodiment, consequently, the cost is reduced as compared with the conventional multiple-needle electrode head.

According to the above embodiment, even in the case where the multiple-needle electrode head is made by joining four unit electrode substrates, it is possible to easily obtain a highly accurate linearity over the whole length of the head by finishing the surface of the side plate to which the unit electrode substrates are adhered as a flat plane of high precision, resulting in improvement in quality of printing.

Further, according to the above embodiment, since the electrodes are formed together in every pair of the unit electrode substrates each having a short width, the plating or etching conditions can be easily set and the electrodes can be accurately formed.

Figure 9A:
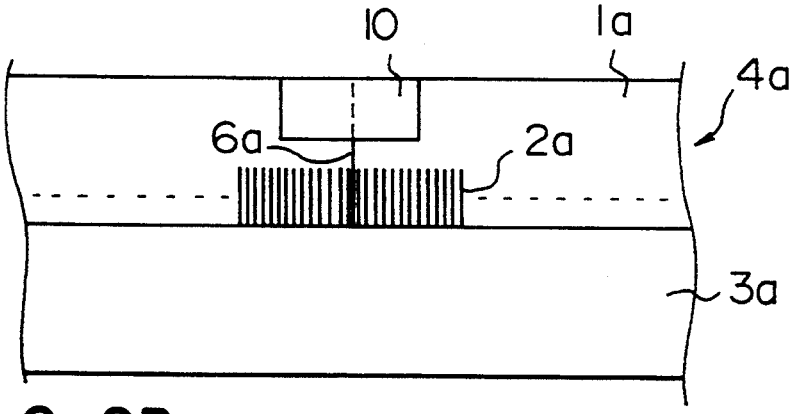
FIGS. 9A and 9B are plan views showing modifications of the head half bodies.
Figure 9B:
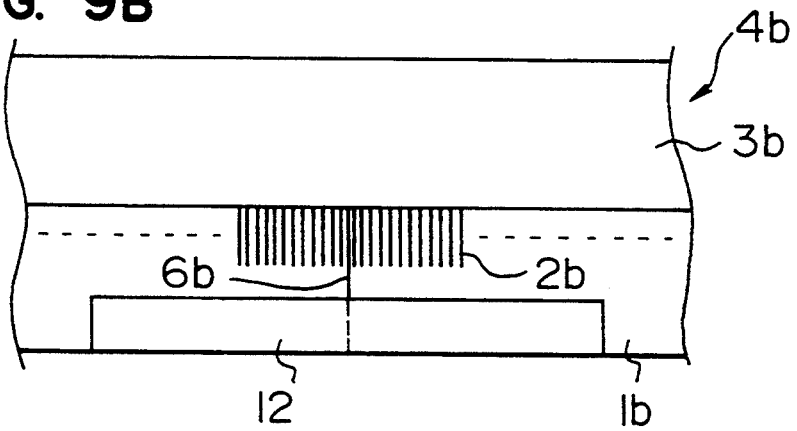

FIGS. 9A and 9B are explanatory diagrams showing modifications of the above embodiment. In case of a multiple-needle electrode head shown in FIG. 9A, a joint reinforcement plate 10 is adhered to a part of the joining portion 6*a* to which the side plate 3*a* is not adhered. In case of a multiple-needle electrode head shown in FIG. 9B, a joint reinforcement plate 12 also serving as a power source substrate is adhered to a part of the joining portion 6*b* of the unit electrode substrates 1*b* to which the side plate 3*b* is not adhered. According to the above modifications, by providing the joint reinforcement plate 10 or 12, the joining portions 6*a* and 6*b* can be strengthen so that the whole four unit electrode substrates 1*a* can be finished as co-extending on a flat surface. Consequently, it is possible to easily perform the bonding work of driving electronic parts or the like (not shown) installed on the unit electrode substrate.

Figure 10A:
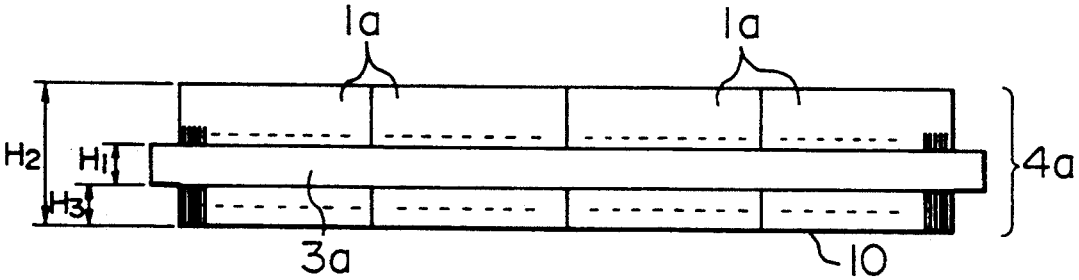
FIGS. 10A and 10B are plan views showing other modifications of the head half bodies.
Figure 10B:
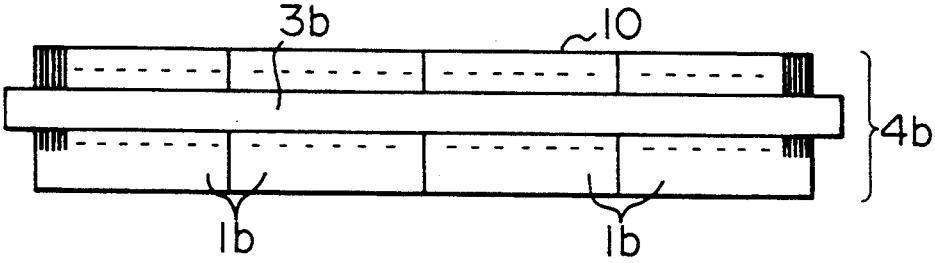

In the above embodiment, the side plate extends up to the operational surface of the head. However, as shown in FIGS. 10A and 10B, it is not necessarily required that the side plate extends up to the head operational surface. In this embodiment, the head half body 4*a* or 4*b* is made by adhering to an integral side plate 3 four unit electrode substrates 1 which are joined in the row direction of the electrodes. However, the number of the unit electrode substrates 1 of each half body may be two or more. Although the above embodiment has been described with respect to the case where a length of the unit electrode substrate 1 is equal to 9 inches, the length of the unit electrode substrate 1 can be also set to any value within a range such that such a unit electrode substrate can be formed by the existing plating apparatus or the like. Further, when the unit electrode substrates 1 are joined, the joining portions 6*a* and 6*b* may be set to any positions so long as the end portions of the electrodes provide a predetermined positional pattern such as a zigzag pattern on the operational surface 10 of the head. The electrode pitch can be also set to any value other than 400 d.p.i. (200 d.p.i. for one side).

Although the above embodiment has been described with respect to the case where the electrodes of each pair of unit electrode substrates are simultaneously formed by using one printed wiring board, the electrodes can be also formed every unit electrode substrate.

According to the invention as described above, an electrode substrate of a longer length can be easily manufactured by using an existing plating apparatus or exposing apparatus, because the long electrode substrate is made by joining electrode substrates of shorter length in a direction of row of the electrodes. In addition, it is possible to provide each electrode substrate with a highly accurate linearity, since each electrode substrate is made with a shorter width. Further, since the electrode substrates are joined one another by using a common side plate, it is possible to obtain a highly accurate linearity over the whole length thereof. Therefore, the present invention provides a multiple-needle electrode head which is particularly suitable for use with a long electrostatic plotter or the like and a method of manufacturing the same.

What is claimed is:

1. A multiple-needle electrode head comprising:

a first head half body including a first side plate and a plurality of electrode substrates adhered to said first side plate, each of said electrode substrates having needle-shaped electrodes formed in a row on one surface of said each electrode substrate and insulated from each other, said plurality of electrode substrates being joined in a direction of the row of the electrodes;

a second head half body including a second side plate and a plurality of electrode substrates adhered to said second side plate, each of said electrode substrates having needle-shaped electrodes formed in a row on one surface of said each electrode substrate and insulated from each other, said plurality of electrode substrates being joined in a direction of the row of the electrodes;

means for coupling said first and second head half bodies in a manner such that said plurality of electrode substrates of each of said head half bodies are located inside and the electrodes of the first head half body are insulated from the electrodes of the second head half body;

wherein the electrodes formed on each of said plurality of electrode substrates in each of said head half bodies are arranged in the row direction at equal intervals with a predetermined pitch and a distance between one end of at least one of adjacent two of said plurality of electrode substrates in each of said head half bodies, which one end is in contact with one end of the other of said adjacent two electrode substrates, and a center of one of the electrodes formed on said one of said adjacent two electrode substrates and closest to said one end, is smaller than a half of said pitch.

2. A head according to claim 1, wherein a junction between adjacent two of said plurality of electrode substrates in one of said first and second head half bodies is located almost at a center of one of the electrodes of the other of said head half bodies.

3. A head according to claim 1, wherein in each of said first and second head half bodies, said one surface of each of said electrode substrates is adhered to said side plate associated therewith.

4. A head according to claim 3, wherein a junction between adjacent two of said plurality of electrode substrates in one of said first and second head half bodies is located almost at a center of one of the electrodes of the other of said head half bodies.

5. A head according to claim 1, wherein in each of said first and second head half bodies, a surface of each of the electrode substrates opposite to said one surface thereof is adhered to an associated one of said first and second side plates.

6. A head according to claim 5, wherein a junction between adjacent two of said plurality of electrode substrates in one of the first and second head half bodies is located almost at a center of one of said electrodes of the other of said head half bodies.

7. A head according to claim 1, wherein said first and second head half bodies are coupled so as to form an operational surface of said multiple-needle electrode head, and ends of the electrodes of said first head half body and ends of the electrodes of said second head half bodies are exposed to said operational surface.

8. A head according to claim 7, wherein each of the electrode substrates of said first and second head half bodies has one edge which is exposed to said operational surface, the electrodes are formed in a first area closer to said edge on said one surface of the electrode substrates, and an associated one of said first and second side plates is adhered to a second area on said one surface which includes said edge and does not exceed the first area.

9. A head according to claim 8, wherein a junction between adjacent two of said plurality of electrode substrates in one of said first and second head half bodies is located almost at a center of one of said electrodes of the other of said head half bodies.

10. A method of manufacturing a multiple-needle electrode head, comprising the steps of:

forming a selected number of electrode substrates, each having needle-shaped electrodes formed in a row on its one surface at equal intervals with a predetermined pitch and insulated from each other;

forming a pair of head half bodies, each being formed by joining a plurality of the electrode substrates in a direction of the row of said electrodes and adhering the joined electrode substrates to one side plate; and coupling said pair of head half bodies so that each of the electrode substrates is located inside and the electrodes of said head half bodies are insulated from each other and such that a distance between one end of at least one of adjacent two of said plurality of electrode substrates in each of said head half bodies, which one end is in contact with one end of the other of said adjacent two electrode substrates, and a center of one of the electrodes formed on said one of said adjacent two electrode substrates and closest to said one end, is smaller than a half of said pitch.

11. A multiple-needle electrode head comprising:

a first head half body including a first side plate and a plurality of electrode substrates adhered to said first side plate, each of said electrode substrates having one surface and needle-shaped electrodes formed in a row on said one surface and insulated from each other, said plurality of electrode substrates being joined in a direction of the row of the electrodes;

a second head half body including a second side plate and a plurality of electrode substrates adhered to said second side plate, each of said electrode substrates having one surface and needle-shaped electrodes formed in a row on said one surface and insulated from each other, said plurality of electrode substrates being joined in a direction of the row of the electrodes;

means for coupling said first and second head half bodies in a manner such that said plurality of electrode surfaces of each of said head half bodies are located inside and he electrodes of the first head half body are insulated from electrodes of the second head half body; and wherein a junction between adjacent two of said plurality of electrode substrates in one of the first and second head half bodies is located almost at a center of one of said electrodes of the other of said head half bodies.

* * * * *